US011659873B2

(12) United States Patent
Gonzalez et al.

(10) Patent No.: US 11,659,873 B2
(45) Date of Patent: May 30, 2023

(54) PANTS WITH AN UNDERSIDE OPENING

(71) Applicant: SheFly Apparel LLC, Burlington, VT (US)

(72) Inventors: Bianca Gonzalez, Burlington, VT (US); Georgia Grace Edwards, Burlington, VT (US)

( * ) Notice: Subject to any disclaimer, the term of this patent is extended or adjusted under 35 U.S.C. 154(b) by 112 days.

(21) Appl. No.: 16/756,966

(22) PCT Filed: Sep. 6, 2019

(86) PCT No.: PCT/US2019/049841

§ 371 (c)(1),
(2) Date: Apr. 17, 2020

(87) PCT Pub. No.: WO2020/051392

PCT Pub. Date: Mar. 12, 2020

(65) Prior Publication Data

US 2020/0268066 A1 Aug. 27, 2020

Related U.S. Application Data

(63) Continuation-in-part of application No. 29/694,940, filed on Jun. 14, 2019, now Pat. No. Des. 915,741.
(Continued)

(51) Int. Cl.
*A41D 1/06* (2006.01)

(52) U.S. Cl.
CPC ..... *A41D 1/065* (2013.01)

(58) Field of Classification Search
CPC ..... A41D 1/065; A41D 1/22; A41D 13/1254; A41D 2300/322; A41D 2300/50; A41D 2400/44
See application file for complete search history.

(56) References Cited

U.S. PATENT DOCUMENTS 1,110,054 A 9/1914 Hatch
2,252,885 A 8/1941 Fellroth
(Continued)

FOREIGN PATENT DOCUMENTS

CN 201700421 U 1/2011
JP 11172508 A * 6/1999
(Continued)

OTHER PUBLICATIONS https://patents.google.com/patent/JPH11172508A/en?oq=JP+11172508+A (Year: 1997).*
(Continued)

*Primary Examiner* — Sally Haden

(57) ABSTRACT

A pant with a closable opening encompassing the bottom portion of the crotch allows wearers with female urinary anatomy to urinate without having to lower the pant. The opening may be closed with any suitable mechanism, and preferably a zipper or overlapping flaps. The pant may also include a closable opening running from the center front of the waist band downward to varying degrees such that the pant includes two closable openings on the crotch. Alternatively, a single long closable opening may run from the center front waist area through the bottom of the crotch. This long opening is separated by a blocking member so that a single securement mechanism may be used to open and close the front and rear opening separately.

12 Claims, 10 Drawing Sheets

Related U.S. Application Data

(60) Provisional application No. 62/727,646, filed on Sep. 6, 2018.

(56) References Cited

U.S. PATENT DOCUMENTS

| | | | | | |
|---|---|---|---|---|---|
| 4,117,552 | A * | 10/1978 | Simpson | A41D 13/02 | 2/2.14 |
| 4,554,684 | A * | 11/1985 | Cadoret | A41B 11/143 | 2/227 |
| 4,578,828 | A * | 4/1986 | Smith, Sr. | A41D 1/065 | 2/234 |
| 4,907,298 | A | 3/1990 | Lisowski | | |
| 5,010,595 | A * | 4/1991 | Stradley | A41D 1/06 | 2/227 |
| D403,838 | S | 1/1999 | Lauson | | |
| 6,161,223 | A * | 12/2000 | Andrews | A41D 1/065 | 2/227 |
| 6,243,878 | B1 * | 6/2001 | Khemka | A41D 1/065 | 2/227 |
| D481,196 | S | 10/2003 | Rocha | | |
| 6,941,584 | B1 * | 9/2005 | Matthews | A41D 13/02 | 2/227 |
| 7,832,022 | B1 | 11/2010 | Peters | | |
| 8,091,146 | B1 * | 1/2012 | Anhalt | A41D 1/08 | 2/227 |
| 8,332,966 | B1 * | 12/2012 | Countryman | A41D 1/06 | 2/227 |
| D674,990 | S | 1/2013 | Johnson | | |
| D698,520 | S | 2/2014 | Anderson et al. | | |
| 8,898,813 | B2 | 12/2014 | Davis | | |
| 9,089,173 | B2 * | 7/2015 | Krishnan | A41D 1/065 | |
| RE46,331 | E | 3/2017 | Savage | | |
| 10,945,468 | B1 * | 3/2021 | Hamilton | A41B 9/005 | |
| D915,741 | S * | 4/2021 | Gonzalez | A41D 13/02 | D2/853 |
| 2006/0174399 | A1 * | 8/2006 | Nikolayev | A41D 15/00 | 2/227 |
| 2011/0167537 | A1 * | 7/2011 | Christoff | A41D 1/065 | 2/228 |
| 2013/0263353 | A1 * | 10/2013 | Mc Combs | A41D 1/065 | 2/79 |
| 2015/0342272 | A1 | 1/2015 | Bonime et al. | | |
| 2015/0101105 | A1 * | 4/2015 | Malan | A41D 1/065 | 2/227 |
| 2016/0015093 | A1 * | 1/2016 | Hochman | A41D 1/06 | 2/234 |
| 2016/0219945 | A1 * | 8/2016 | Chen | A41D 1/065 | |
| 2016/0302497 | A1 * | 10/2016 | Wu | A41B 9/004 | |
| 2017/0295850 | A1 | 10/2017 | Birkas | | |
| 2019/0037933 | A1 * | 2/2019 | Mercer | A41D 1/065 | |

FOREIGN PATENT DOCUMENTS

| | | | |
|---|---|---|---|
| JP | 2002069714 | A * | 3/2002 |
| KR | 200222182 | Y1 | 5/2001 |
| KR | 200309831 | Y1 | 4/2003 |

OTHER PUBLICATIONS https://patents.google.com/patent/JP2002069714A/en?oq=JP+2002069714+A (Year: 2000).*

Nikki, et al. "3 Types of Zipper Stops." Do-It-Yourself Advice Blog., Sailrite, Jul. 9, 2015, https://sailrite.wordpress.com/2015/07/09/3-types-of-zipper-stops/. (Year: 2015).*

"EZPeePants", https://ezpeepants.com/.

Ezpeepants, "EZPeePants", https://ezpeepants.com/, Sep. 24, 2018.

Thomas, "International Search Report and Written Opinion", related to PCT Application No. PCT/US19/49841, dated Jan. 9, 2020.

Thomas, "Invitation to Pay Additional Fees and, Where Applicable, Protest Fee", PCT/US19/49841, dated Nov. 6, 2019.

* cited by examiner

PANTS WITH AN UNDERSIDE OPENING

RELATED APPLICATION DATA

This application claims the benefit of priority to U.S. Provisional Application No. 62/727,646, filed Sep. 6, 2018, and titled "Pants with an Underside Opening," and U.S. Design Application No. 29/694,940, filed Jun. 14, 2019 and titled "Pants with an Underside Zipper," and each of which is incorporated by reference herein in its entirety.

FIELD OF THE INVENTION

The present invention generally relates to pants. In particular, the present invention is directed to Pants with an Underside Opening.

BACKGROUND

Pants, including shorts, capris, under-layer or base-layer pants, work-pants, leggings, underwear, and outerwear (such as ski pants, snow pants, and rain gear) often include a closable opening (or fly) in the center front area that facilitates putting on and taking off of the pants as well as allowing wearers with male urinary anatomy to urinate without having to lower the pants. These designs, however, require wearers with female urinary anatomy to lower the pants off of the waist in order to urinate, thereby exposing more of the body to the elements or to others. This can be inconvenient and unsafe, especially in harsh environments/weather conditions and/or in non-private circumstances, such as may be encountered on lengthy hiking, biking, or skiing adventures or at certain job sites. (The term "pant" is used herein to describe any article of clothing that generally includes a waist, a front crotch area, a rear area, and legs, and can include a variety of items of apparel such as jeans, shorts, leggings, snow pants, ram pants, trousers, knickers, slacks, underwear, etc.).

SUMMARY OF THE DISCLOSURE

In an embodiment, an underside opening for a lower body garment includes a first closable opening running from below a front center of a waistband of the garment down along a crotch area of the garment, a second closable opening running from beyond the first closable opening, through the crotch area, and up toward a rear center of the waistband, a zipper track running from below the front center of the waistband, through the crotch area, and up toward the rear center of the waistband, an exterior blocking member traversing the zipper track, the exterior blocking member being attached to an exterior of the garment and separating the first closable opening from the second closable opening, and an interior blocking member traversing the zipper track, the interior blocking member being attached to an interior of the garment opposite the exterior blocking member. The zipper track is continuous and includes a first zipper pull on a first side of the exterior blocking member and a second zipper pull on a second side of the exterior blocking member.

In another embodiment, a pair of pants includes a first leg opening, a second leg opening, a waist opening, a lowest crotch point, a first closable opening running from below a front center of the waist opening down toward the lowest crotch point, a second closable opening running from beyond the first closable opening, through the lowest crotch point, and up toward a rear center of the waist opening, a zipper track running along the first closable opening and the second closable opening, an exterior blocking member traversing the zipper track, the exterior blocking member being attached to an exterior of the pants and separating the first closable opening from the second closable opening, and an interior blocking member traversing the zipper track, the interior blocking member being attached to an interior of the pants opposite the exterior blocking member. The zipper track is continuous and includes a first zipper pull on a first side of the exterior blocking member and a second zipper pull on a second side of the exterior blocking member.

In another embodiment, a closable opening for a crotch area of a garment includes a single, continuous zipper track running from below a front portion of a waistband of the garment, through the crotch area, and up toward a rear portion of the waistband, wherein the zipper track has an inner side and an outer side, an exterior blocking member traversing the outer side of the zipper track, wherein the exterior blocking member is designed and configured to prevent a zipper pull from continuing along the zipper track, and an interior blocking member traversing the inner side of the zipper track and being opposite the exterior blocking member, wherein the interior blocking member is designed and configured to prevent a zipper pull from continuing along the zipper track. The zipper track includes a first zipper pull on a first side of the exterior blocking member and a second zipper pull on a second side of the exterior blocking member.

In another embodiment, a lower body garment has an interior side and an exterior side, and the garment includes a first leg opening, a second leg opening, a waist opening, a lowest crotch point, a first closable opening running from below a front center of the waist opening down toward the lowest crotch point, a second closable opening running from beyond the first closable opening, through the lowest crotch point, and up toward a rear center of the waist opening, a first zipper track running along the first closable opening, a second zipper track running along the second closable opening, a first interior flap designed and configured to reversibly cover the first zipper track on the interior side of the garment, a second interior flap designed and configured to reversibly cover the second zipper track on the interior side of the garment, a first exterior flap designed and configured to reversibly cover the first zipper track on the exterior side of the garment, and a second exterior flap designed and configured to reversibly cover the second zipper track on the exterior side of the garment.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

DESCRIPTION OF THE DISCLOSURE

Figure 1:
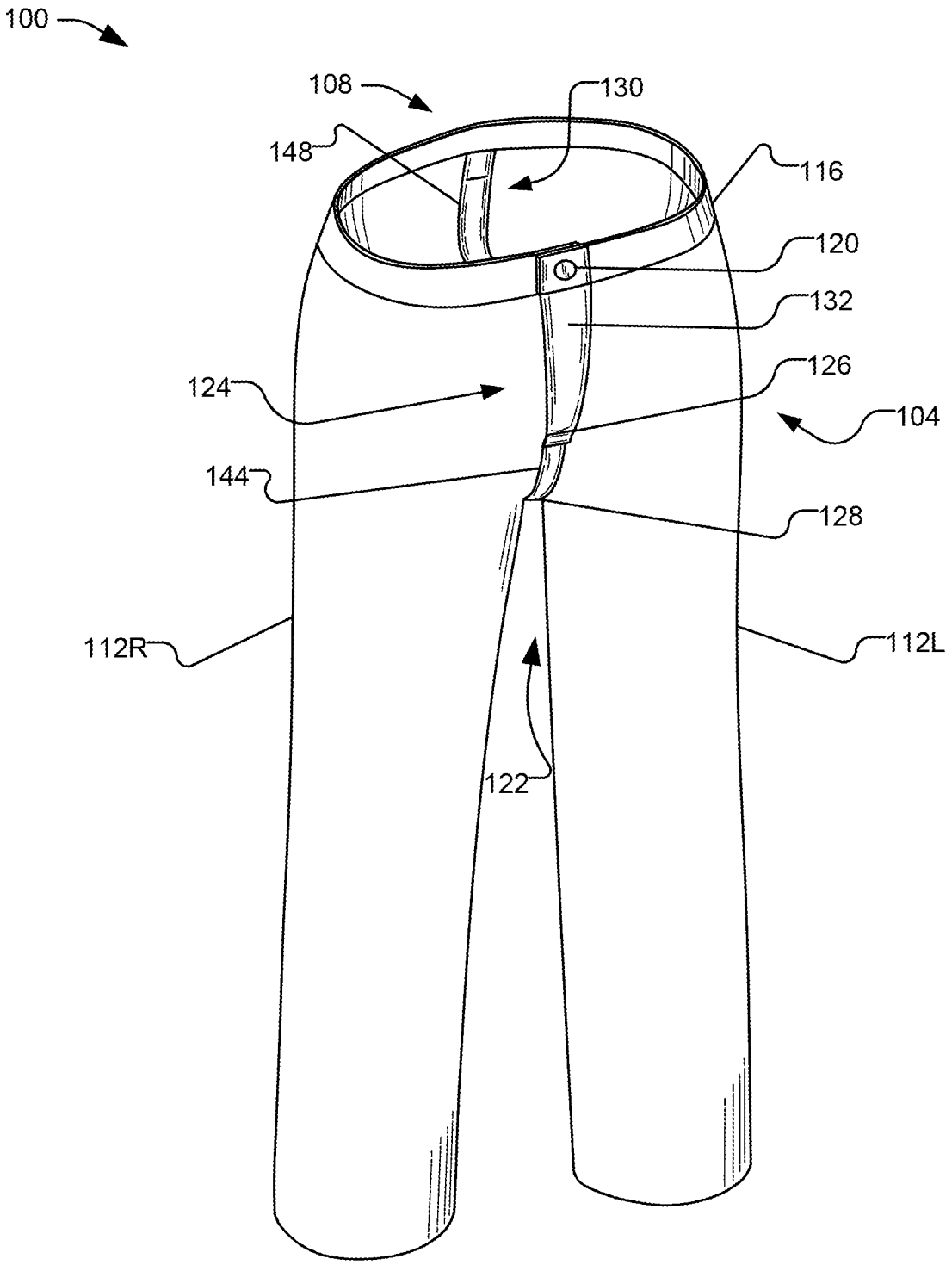
FIG. 1 is a front perspective view of pants with an underside zipper in accordance with an embodiment of the present invention.
Figure 2:
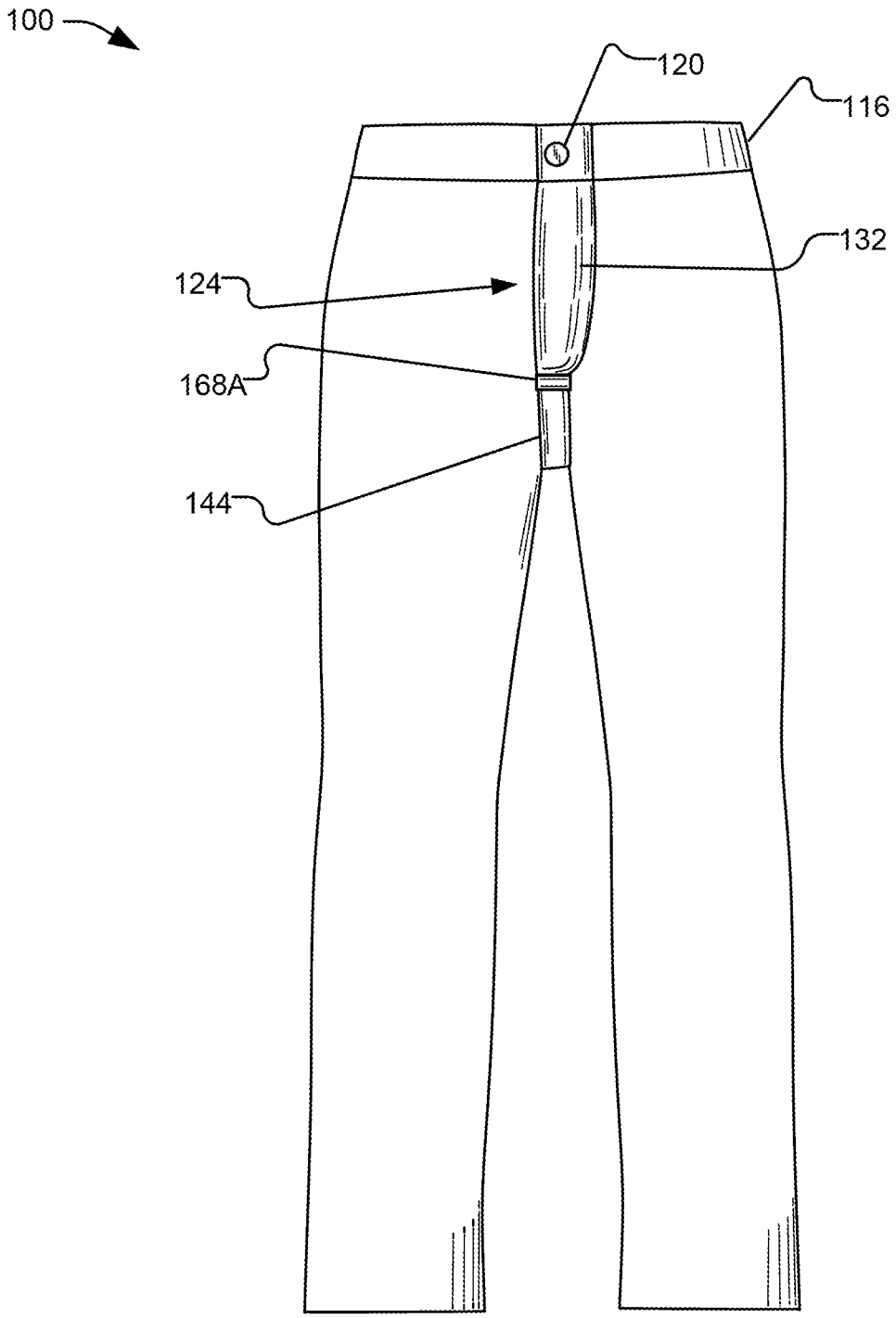
FIG. 2 is a front view of the pants shown in FIG. 1.
Figure 3:
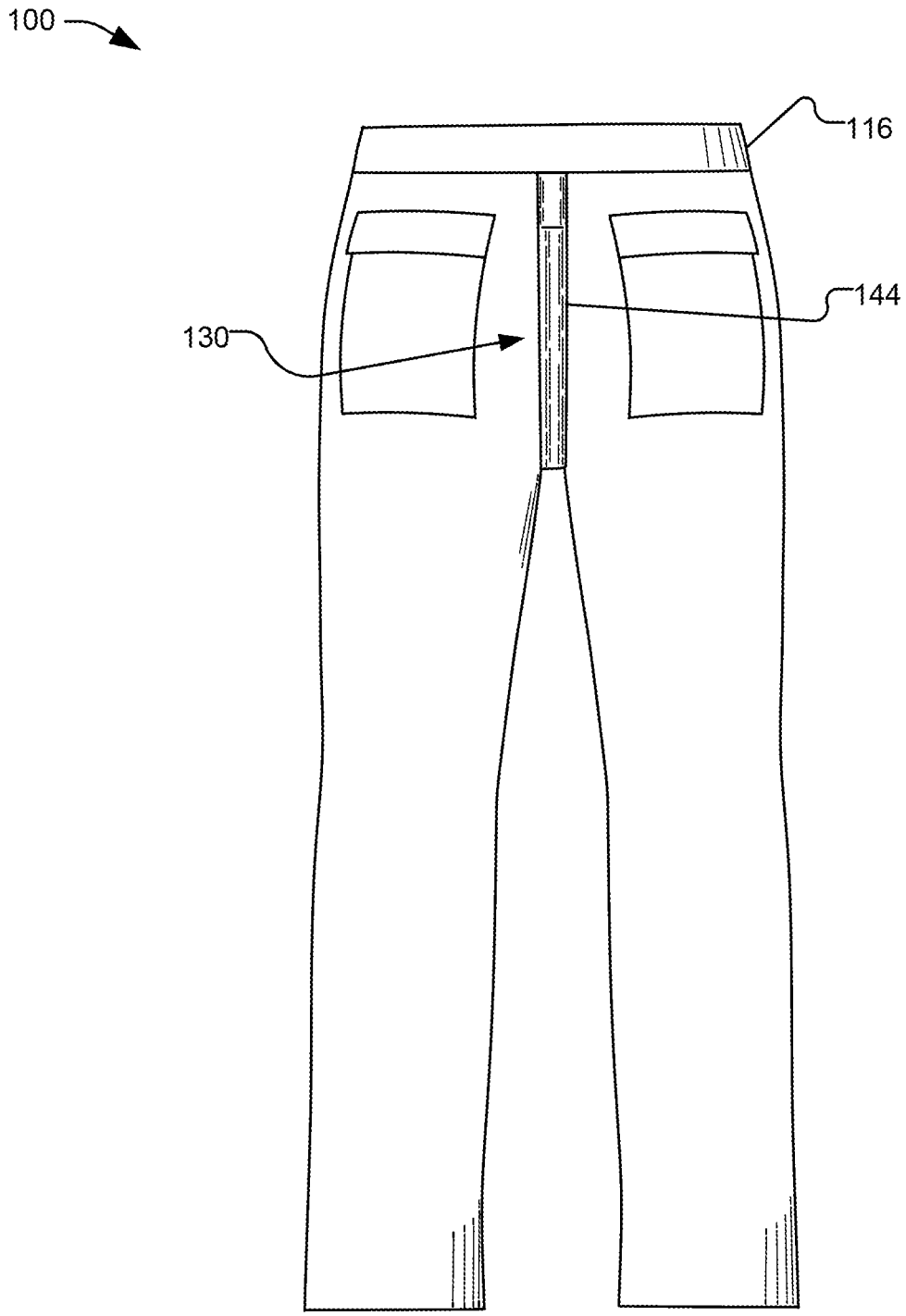
FIG. 3 is a rear view of the pants shown in FIG. 1.
Figure 4:
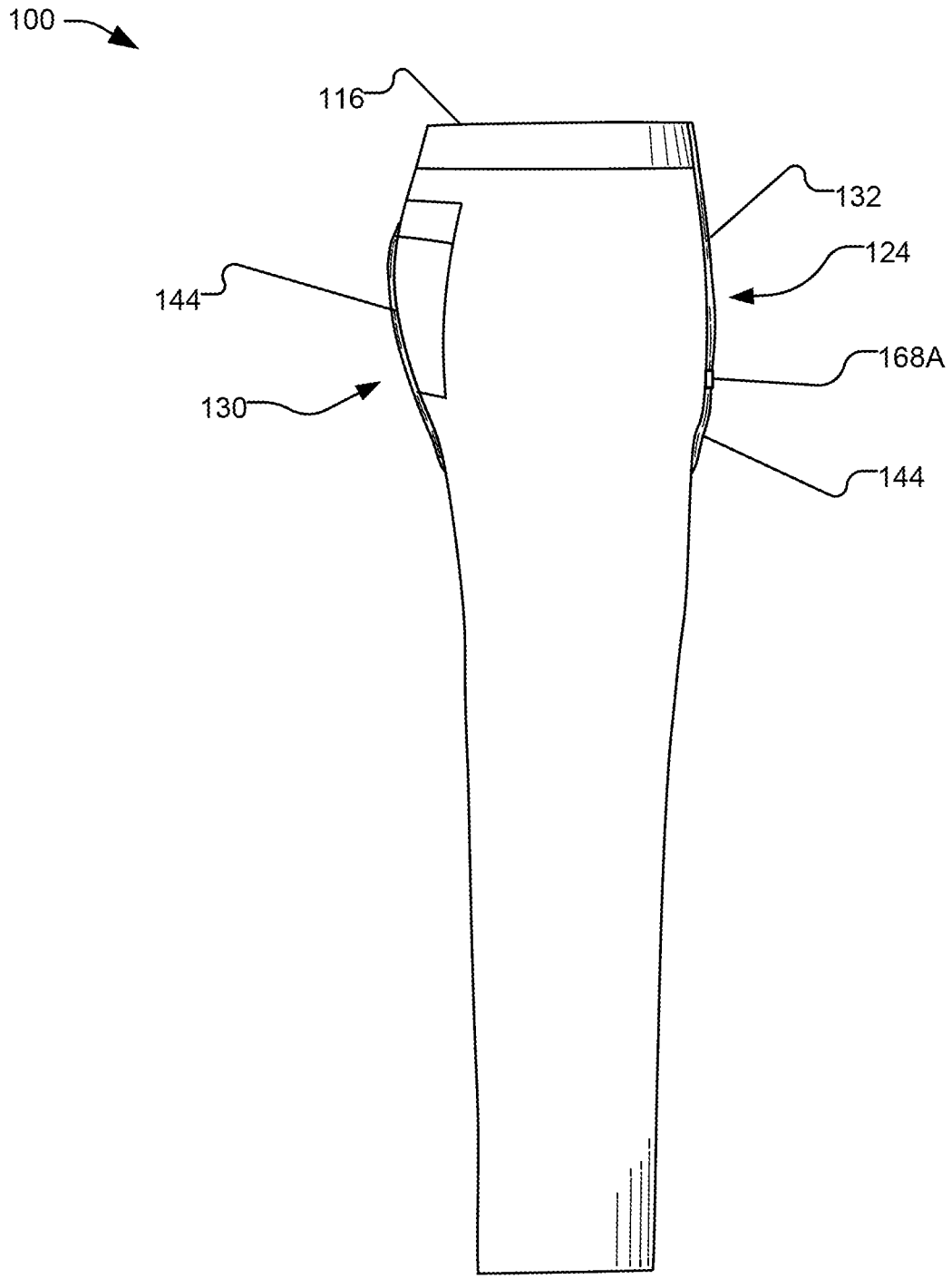
FIG. 4 is a right side view of the pants shown in FIG. 1.
Figure 5:
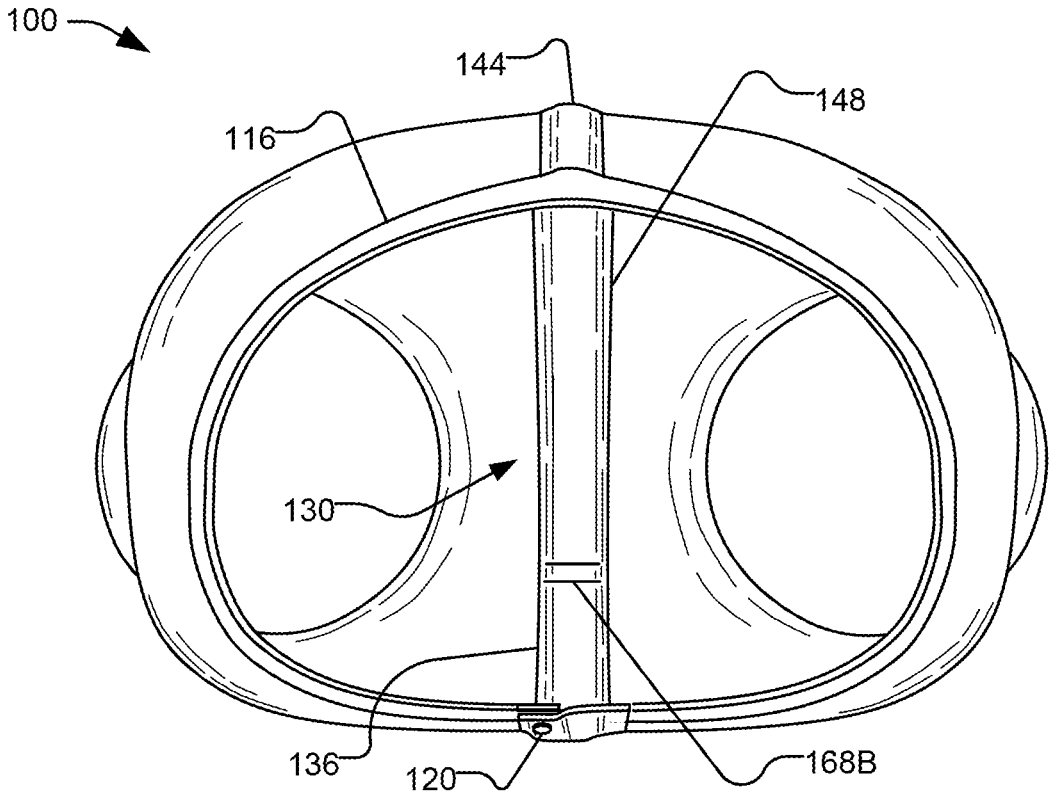
FIG. 5 is a top plan view of the pants shown in FIG. 1.
Figure 6:
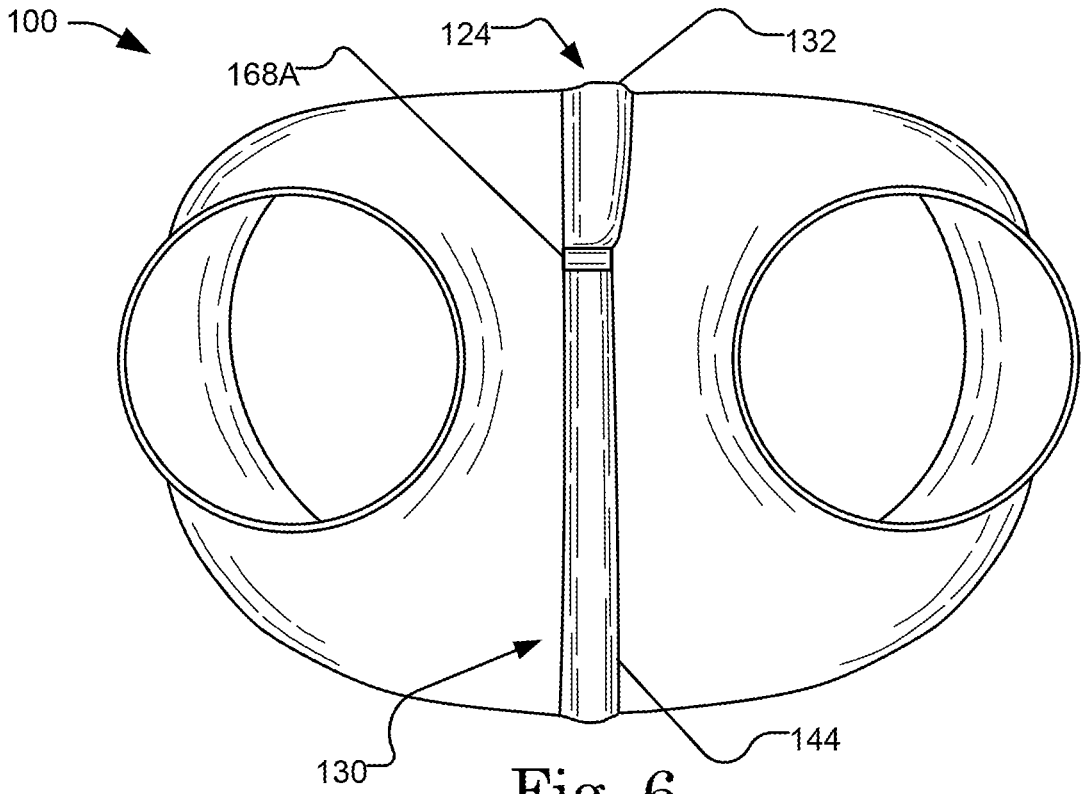
FIG. 6 is a bottom view of the pants shown in FIG. 1.
Figure 7:
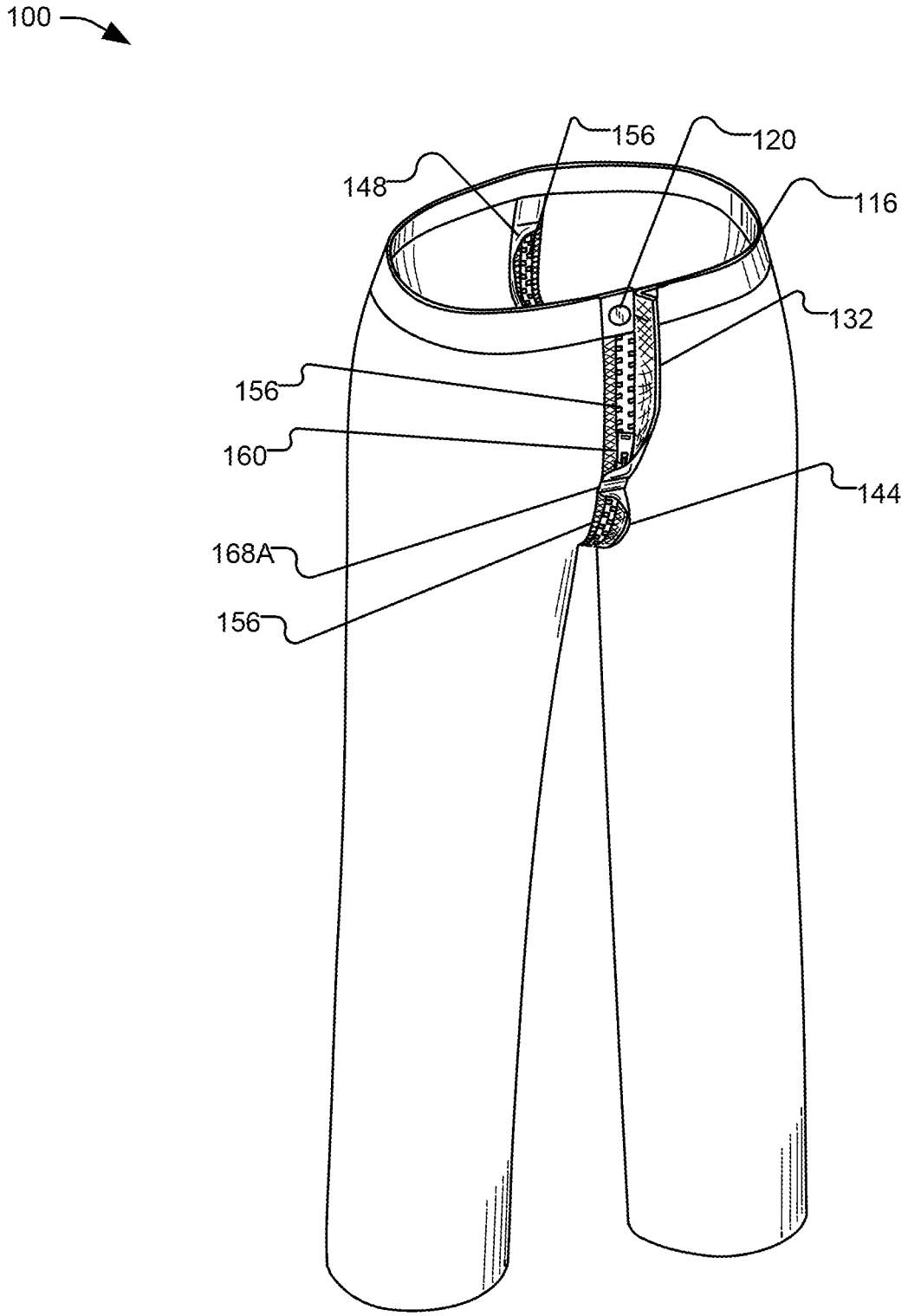
FIG. 7 is a front perspective view of the pants of FIG. 1 with cover flaps turned outward.
Figure 8:
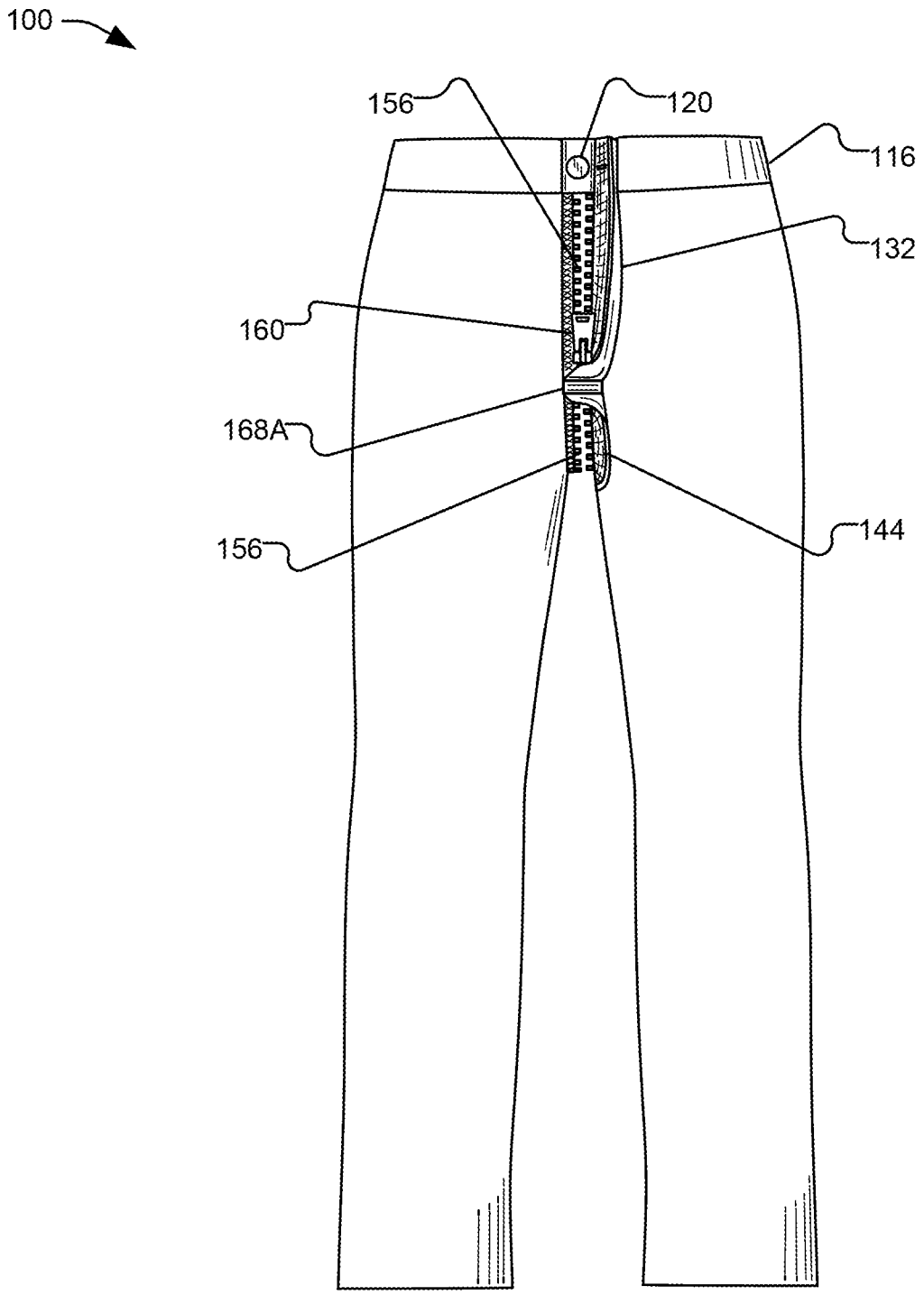
FIG. 8 is a front view of the pants shown in FIG. 7.
Figure 9:
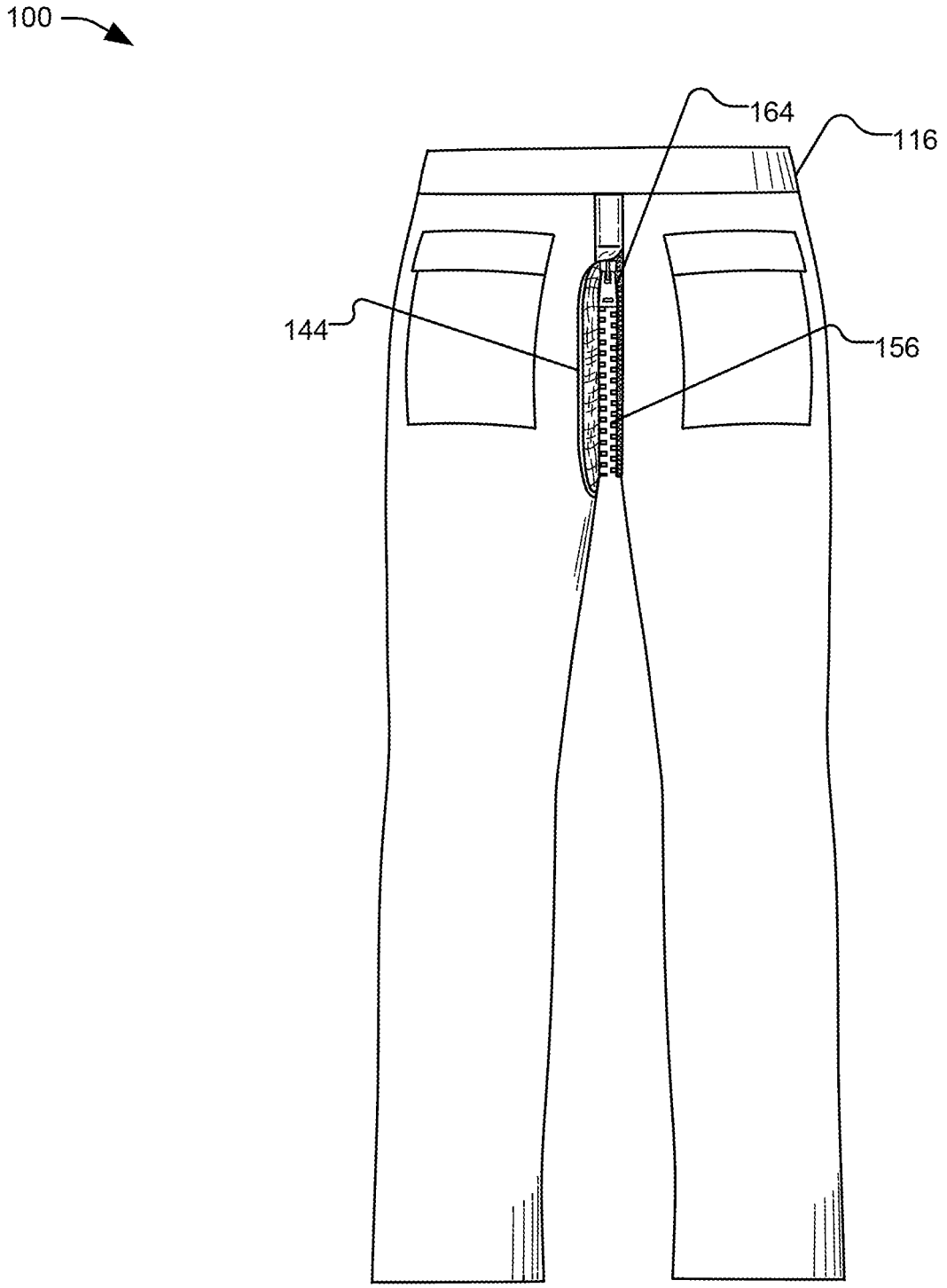
FIG. 9 is a rear view of the pants shown in FIG. 7.
Figure 10:
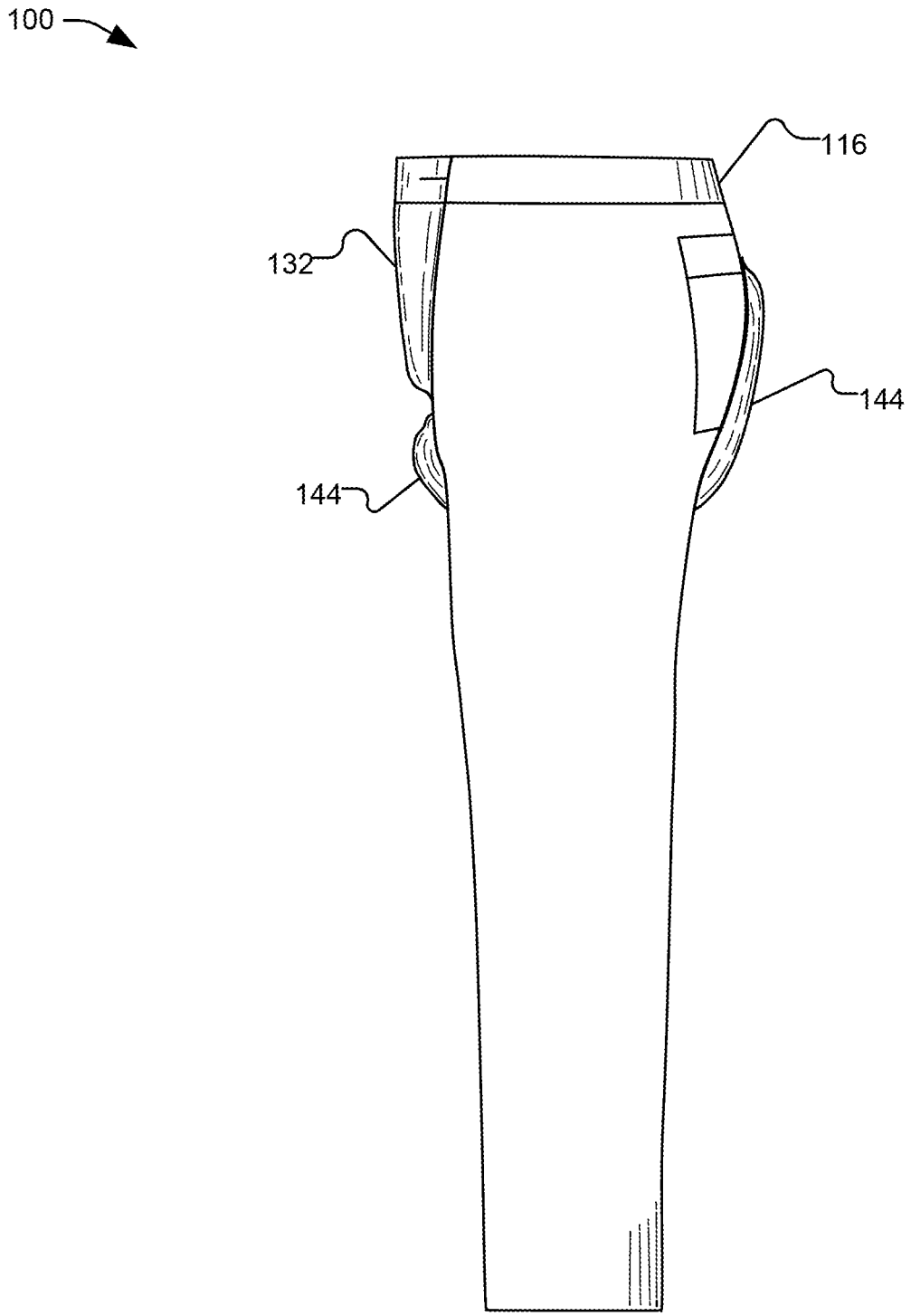
FIG. 10 is a left side view of the pants shown in FIG. 7.

Pants with an underside opening of the present invention facilitate the urination of those persons possessing female urinary anatomy or, potentially, for those possessing male or female urinary anatomy who wish to defecate without having to lower the pants off of the waist. In an embodiment, the pants of the present invention include two, separately openable and closable openings, an underside opening and a front or fly opening. In another embodiment, the two openings share a continuous closing mechanism that is separated by exterior and interior blocking members. thereby allowing the openings to be operated separately. In another embodiment, under layer garments such as long underwear or thermal underwear are provided with a slit or opening along the bottom of the crotch area. Alternatively, a single long closable opening may run from the center front waist area through the bottom of the crotch.

Turning to the figures, in an embodiment, pants with an underside opening of the present invention, for example full length pants 100 shown in FIGS. 1-12, include a front 104, a back 108, a left leg portion 112L, a right leg portion 112R, a waistband 116, a waistband closure 120, and a crotch area 122. A first closable opening 124 (e.g., a fly) runs from just below waistband closure 120 downward along the center of the crotch area to a location 126 near or above a low point 128 of the crotch area (low point 128 is the lowest point of the crotch area when a garment is being worn or held upright). A second closable opening 130 runs from just below or beyond location 126, along the crotch area, and back up along the back side of the crotch area terminating at or near the center of back side 108 of waistband 116.

First closable opening 124 includes an exterior front flap 132 and an interior front flap 136, each of which reversibly covers a respective side of a closing mechanism for first closable opening 124, such as a zipper or buttons. Second closable opening 130 includes an exterior back flap 144 and an interior back flap 148, each of which reversibly covers a respective side of a closing mechanism for second closable opening 130, such as a zipper or buttons. Exterior flaps 132 and 144 may be secured on one side or on both sides (in which case the flaps would be split down the middle) to the exterior side of pants 100 and are designed and configured to cover respective closing mechanisms for appearance sake, as well as provide insulating properties when the closing mechanism is thermally conductive. Interior flaps 136 and 148 may be secured on one side or on both sides (in which case the flaps would be split down the middle) to the interior side of pants 100 and are designed and configured to cover respective closing mechanisms in order to provide an insulating (and protective) barrier between the closing mechanisms and the user. Flaps 132. 136, 144, and 148 may include a slight curve that generally follows the slight curve in the material that forms crotch area 122 of pants 100 in order to help reduce bunching when worn.

Figure 11:
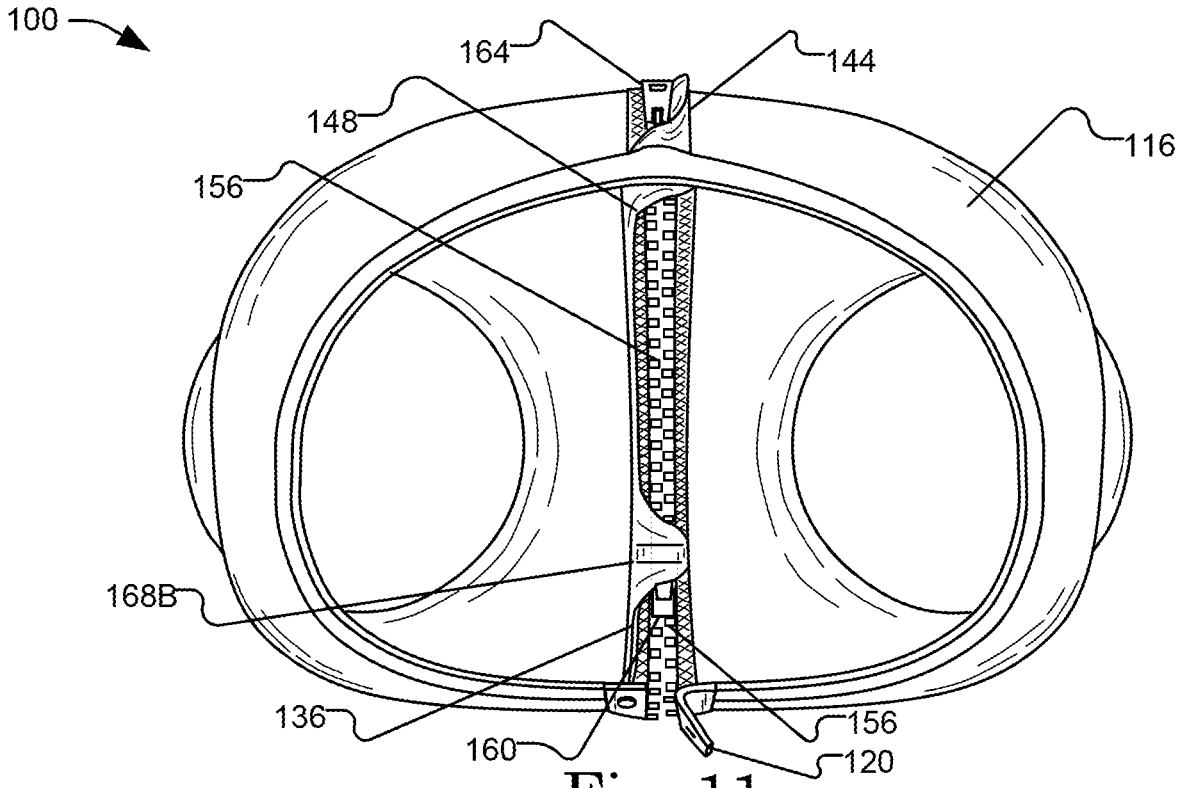
FIG. 11 is a top view of the pants shown in FIG. 7.
Figure 12:
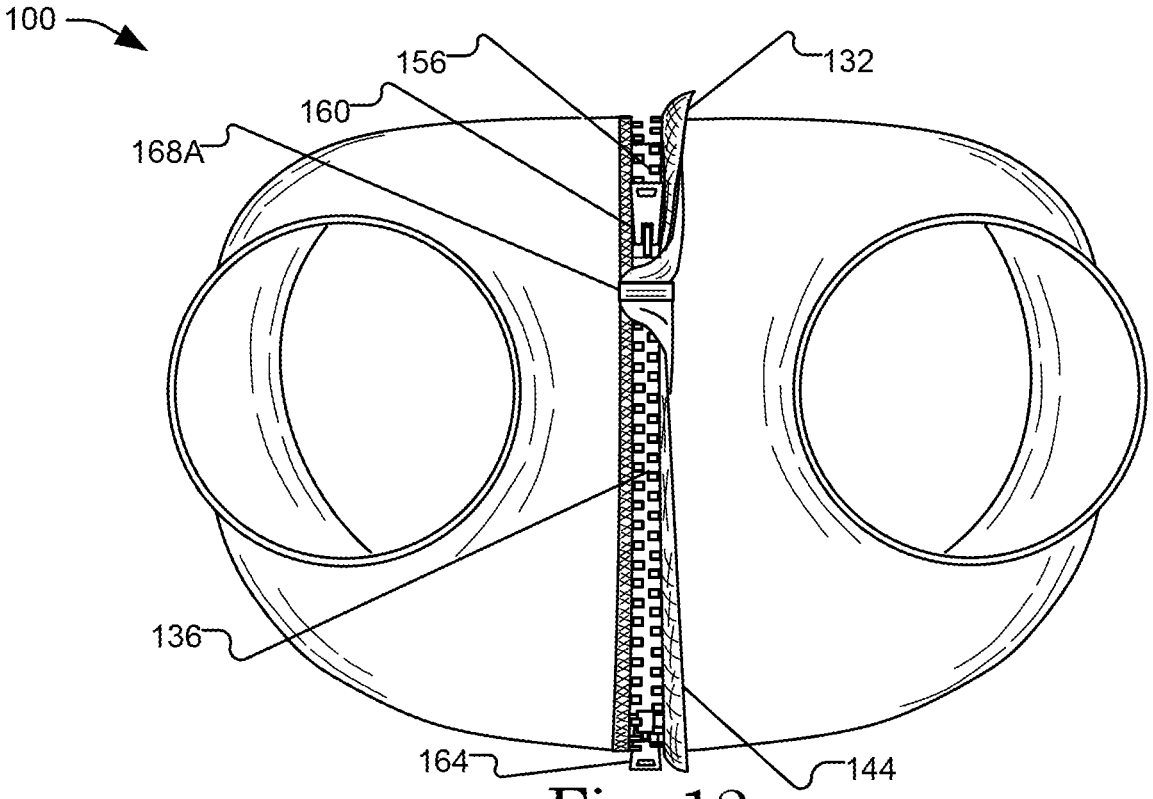
FIG. 12 is a bottom view of the pants shown in FIG. 7.

In a preferred embodiment, and as can best be seen for example in FIGS. 11-12, the closing mechanisms for first closable opening 124 and second closable opening 130 made with a single zipper track 156 running along the length of the crotch from just below the center of the front of waistband 116 to just below the center of the back of waistband 116. In this embodiment, zipper track 156 includes a front pull 160 and a rear pull 164, and is traversed by a pair of blocking members 168 (exterior blocking member 168A and interior blocking member 168B) that prevents front pull 160 and rear pull 164 from passing. In this way, first closable opening 124 may be opened and closed by use of front pull 160 and second closable opening 130 may be opened and closed by use of rear pull 164, effectively providing two closing mechanisms while only a single zipper track need be sewn onto pants 100. Blocking members 168 may be any suitable material, including the same material from which pants 100 are made, and be sewn or otherwise secured to pants 100 on both sides across zipper track 156. Exterior blocking member 168A is secured across zipper track 156 on the exterior side of pants 100 while interior blocking member 168B is secured across zipper track 156 on the interior side of pants 100 at a location that is directly opposite the location on the exterior side where exterior blocking member 168A is positioned. Blocking members 168 may be made from the same material as and/or be contiguous with the flaps; in particular, exterior blocking member 168A may be contiguous with exterior flaps 132 and 144 and interior blocking member 168B may be contiguous with interior flaps 136 and 148, with the difference being that the flaps may be repositioned or opened to expose or allow access to zipper track 156, blocking members 168 cannot be repositioned in such a manner by wearer under typical use conditions.

In another embodiment, a first zipper secures a fly opening that runs from the top of the waistline of a pair of pants down toward the bottom of the crotch, as may often be found on pants. A second zipper that secures a second opening that may start approximately 0-3 inches further toward the bottom of the crotch than where the first opening/zipper ends. This second opening/zipper continues through the bottom of the crotch and up the backside of the pants a distance sufficient to allow for female urination or unitary defecation, e.g., up to approximately just after a location that would be adjacent to the anal opening on a wearer, though in alternative embodiments the second opening/zipper may extend up to the tailbone.

The second zipper is preferably discreetly hidden by a flap on the outside that covers the zipper, the flap being a fabric strip or the like that is about one-quarter inch to about two inches in width. A second flap or liner may be included on the inside of the pants. The second flap is sized and located to cover the inside facing portion of the zipper to thereby prevent the second zipper from coming into contact with skin when the pants are worn. Both the inner and outer flaps may include a slight curve that generally follows the slight curve in the material that forms the crotch area of the pants in order to help reduce bunching.

In another exemplary embodiment, under layer garments such as long underwear or thermal underwear are provided with a slit or opening along the bottom of the crotch area. The opening is sized and positioned to allow wearers with female urinary anatomy to urinate without having to lower or remove the garment. Because these types of garments are typically worn beneath other garments, the opening is closed or covered preferably without the use of a securement mechanism such as a zipper or buttons but rather through the use of overlapping flaps on either side. These garments may be used separately or in conjunction with the outerwear described above.

In an embodiment, an underside opening for a lower body garment includes a first closable opening running from below a front center of a waistband of the garment down along a crotch area of the garment, a second closable opening running from beyond the first closable opening, through the crotch area, and up toward a rear center of the waistband, a zipper track miming from below the front center of the waistband, through the crotch area, and up toward the rear center of the waistband, an exterior blocking member traversing the zipper track, the exterior blocking member being attached to an exterior of the garment and separating the first closable opening from the second closable opening, and an interior blocking member traversing the zipper track, the interior blocking member being attached to an interior of the garment opposite the exterior blocking member. The zipper track is continuous and includes a first zipper pull on a first side of the exterior blocking member and a second zipper pull on a second side of the exterior blocking member.

Additionally or alternatively, an interior flap designed and configured to reversibly cover the zipper track is included.

Additionally or alternatively, an exterior flap designed and configured to reversibly cover the zipper track is included.

Additionally or alternatively, the interior flap and the exterior flap include curvatures to prevent bunching during normal wear of the garment by a wearer.

Additionally or alternatively, the first zipper pull opens and closes the zipper track along the first closable opening and the second zipper pull opens and closes the zipper track along the second closable opening.

Additionally or alternatively, a third zipper pull that opens and closes the zipper track along the second closable opening is included.

In another embodiment, a pair of pants includes a first leg opening, a second leg opening, a waist opening, a lowest crotch point, a first closable opening running from below a front center of the waist opening down toward the lowest crotch point, a second closable opening running from beyond the first closable opening, through the lowest crotch point, and up toward a rear center of the waist opening, a zipper track miming along the first closable opening and the second closable opening, an exterior blocking member traversing the zipper track, the exterior blocking member being attached to an exterior of the pants and separating the first closable opening from the second closable opening, and an interior blocking member traversing the zipper track, the interior blocking member being attached to an interior of the pants opposite the exterior blocking member. The zipper track is continuous and includes a first zipper pull on a first side of the exterior blocking member and a second zipper pull on a second side of the exterior blocking member.

Additionally or alternatively, an interior flap designed and configured to reversibly cover the zipper track is included.

Additionally or alternatively, an exterior flap designed and configured to reversibly cover the zipper track is included.

Additionally or alternatively, the interior flap and the exterior flap include curvatures to prevent bunching during normal wear of the pants by a wearer.

Additionally or alternatively, the first zipper pull opens and closes the zipper track along the first closable opening and the second zipper pull opens and closes the zipper track along the second closable opening.

In another embodiment, a closable opening for a crotch area of a garment includes a single, continuous zipper track running from below a front portion of a waistband of the garment, through the crotch area, and up toward a rear portion of the waistband, wherein the zipper track has an inner side and an outer side, an exterior blocking member traversing the outer side of the zipper track, wherein the exterior blocking member is designed and configured to prevent a zipper pull from continuing along the zipper track, and an interior blocking member traversing the inner side of the zipper track and being opposite the exterior blocking member, wherein the interior blocking member is designed and configured to prevent a zipper pull from continuing along the zipper track. The zipper track includes a first zipper pull on a first side of the exterior blocking member and a second zipper pull on a second side of the exterior blocking member.

Additionally or alternatively, an interior flap designed and configured to reversibly cover the zipper track is included.

Additionally or alternatively, an exterior flap designed and configured to reversibly cover the zipper track is included.

Additionally or alternatively, the interior flap and the exterior flap include curvatures to prevent bunching during normal wear of the garment by a wearer.

Additionally or alternatively, the interior flap is connected to the interior blocking member.

Additionally or alternatively, the exterior flap is connected to the exterior blocking member.

Additionally or alternatively, the first zipper pull closes the zipper track when moving away from the exterior blocking member and the second zipper pull closes the zipper track when moving away from the exterior blocking member.

In another embodiment, a lower body garment has an interior side and an exterior side, and the garment includes a first leg opening, a second leg opening, a waist opening, a lowest crotch point, a first closable opening running from below a front center of the waist opening down toward the lowest crotch point, a second closable opening running from beyond the first closable opening, through the lowest crotch point, and up toward a rear center of the waist opening, a first zipper track running along the first closable opening, a second zipper track running along the second closable opening, a first interior flap designed and configured to reversibly cover the first zipper track on the interior side of the garment, a second interior flap designed and configured to reversibly cover the second zipper track on the interior side of the garment, a first exterior flap designed and configured to reversibly cover the first zipper track on the exterior side of the garment, and a second exterior flap designed and configured to reversibly cover the second zipper track on the exterior side of the garment.

Additionally or alternatively, two zipper pulls are included on the second zipper track.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. An underside opening for a lower body garment, the underside opening comprising: a first closable opening running from below a front center of a waistband of the garment down along a crotch area of the garment; a second closable opening running from beyond the first closable opening, through the crotch area, and up toward a rear center of the waistband; a zipper track running from below the front center of the waistband, through the crotch area, and up toward the rear center of the waistband;

an interior flap designed and configured to reversibly cover the zipper track;

an exterior flap designed and configured to reversibly cover the zipper track, the exterior flap having a length and a width, the length being substantially parallel to the zipper track;

a single exterior blocking member traversing the zipper track, the exterior blocking member being attached to an exterior of the garment and separating the first closable opening from the second closable opening, wherein the single exterior blocking member comprises a portion of the width of the exterior flap sewn into the garment over the zipper track across an entirety of the width of the exterior flap; and a single interior blocking member traversing the zipper track, the interior blocking member being attached to an interior of the garment opposite the exterior blocking member, wherein the single interior blocking member comprises a portion of the interior flap sewn into the garment over the zipper track across the interior flap, wherein the zipper track is continuous and includes a first zipper pull on a first side of the exterior blocking member and a second zipper pull on a second side of the exterior blocking member.

2. The underside opening according to claim 1, wherein the interior flap and the exterior flap include curvatures to prevent bunching during normal wear of the garment by a wearer.

3. The underside opening according to claim 2, wherein the first zipper pull opens and closes the zipper track along the first closable opening and the second zipper pull opens and closes the zipper track along the second closable opening.

4. The underside opening according to claim 3, further including a third zipper pull that opens and closes the zipper track along the second closable opening.

5. A pair of pants comprising:

a first leg opening;

a second leg opening;

a waist opening;

a lowest crotch point;

a first closable opening running from below a front center of the waist opening down toward the lowest crotch point;

a second closable opening running from beyond the first closable opening, through the lowest crotch point, and up toward a rear center of the waist opening;

a zipper track running along the first closable opening and the second closable opening;

an interior flap designed and configured to reversibly cover the zipper track;

an exterior flap designed and configured to reversibly cover the zipper track, the exterior flap having a length and a width, the length being substantially parallel to the zipper track;

a single exterior blocking member traversing the zipper track, the exterior blocking member being attached to an exterior of the pants and separating the first closable opening from the second closable opening, wherein the single exterior blocking member comprises a portion of the width of the exterior flap sewn into the garment over the zipper track across an entirety of the width of the exterior flap; and a single interior blocking member traversing the zipper track, the interior blocking member being attached to an interior of the pants opposite the exterior blocking member, wherein the single interior blocking member comprises a portion of the interior flap sewn into the garment over the zipper track across the interior flap, wherein the zipper track is continuous and includes a first zipper pull on a first side of the exterior blocking member and a second zipper pull on a second side of the exterior blocking member.

6. The pants according to claim 5, wherein the interior flap and the exterior flap include curvatures to prevent bunching during normal wear of the pants by a wearer.

7. The pants according to claim 6, wherein the first zipper pull opens and closes the zipper track along the first closable opening and the second zipper pull opens and closes the zipper track along the second closable opening.

8. A closable opening for a crotch area of a garment comprising:

a single, continuous zipper track running from below a front portion of a waistband of the garment, through the crotch area, and up toward a rear portion of the waistband, wherein the zipper track has an inner side and an outer side;

an interior flap designed and configured to reversibly cover the zipper track;

an exterior flap designed and configured to reversibly cover the zipper track, the exterior flap having a length and a width, the length being substantially parallel to the zipper track;

a single exterior blocking member traversing the outer side of the zipper track, wherein the exterior blocking member is designed and configured to prevent a zipper pull from continuing along the zipper track, wherein the single exterior blocking member comprises a portion of the width of the exterior flap sewn into the garment over the zipper track across an entirety of the width of the exterior flap; and a single interior blocking member traversing the inner side of the zipper track and being opposite the exterior blocking member, wherein the interior blocking member is designed and configured to prevent a zipper pull from continuing along the zipper track, wherein the single interior blocking member comprises a portion of the interior flap sewn into the garment over the zipper track across the interior flap, wherein the zipper track includes a first zipper pull on a first side of the exterior blocking member and a second zipper pull on a second side of the exterior blocking member.

9. The closable opening according to claim 8, wherein the interior flap and the exterior flap include curvatures to prevent bunching during normal wear of the garment by a wearer.

10. The closable opening according to claim 8, wherein the interior flap is connected to the interior blocking member.

11. The closable opening according to claim 10, wherein the exterior flap is connected to the exterior blocking member.

12. The closable opening according to claim 8, wherein the first zipper pull closes the zipper track when moving away from the exterior blocking member and the second zipper pull closes the zipper track when moving away from the exterior blocking member.

* * * * *